US011598579B2

(12) United States Patent
Tseng

(10) Patent No.: US 11,598,579 B2
(45) Date of Patent: Mar. 7, 2023

(54) CONTINUOUS WORKING SYSTEM

(71) Applicant: King Yuan Dar Metal Enterprise Co., Ltd., Changhua (TW)

(72) Inventor: Hui Yu Tseng, Changhua (TW)

(73) Assignee: KING YUAN DAR METAL ENTERPRISE CO., LTD., Changhua (TW)

( * ) Notice: Subject to any disclaimer, the term of this patent is extended or adjusted under 35 U.S.C. 154(b) by 0 days.

(21) Appl. No.: 17/364,969

(22) Filed: Jul. 1, 2021

(65) Prior Publication Data

US 2023/0003451 A1 Jan. 5, 2023

(51) Int. Cl.

| | |
|---|---|
| ***F27B 9/02*** | (2006.01) |
| ***F27B 9/30*** | (2006.01) |
| ***F27B 9/12*** | (2006.01) |
| ***F27B 9/04*** | (2006.01) |

(52) U.S. Cl.

CPC ..... *F27B 9/3005* (2013.01); *F27B 9/042* (2013.01); *F27B 9/12* (2013.01); *F27B 2009/122* (2013.01); *F27B 2009/3027* (2013.01)

(58) Field of Classification Search

CPC ..... F27B 9/029; F27B 9/028; F27B 13/02; F27B 9/02; F27B 9/12; F27B 2009/122; F27D 17/004

See application file for complete search history.

(56) References Cited

U.S. PATENT DOCUMENTS

| | | | | |
|---|---|---|---|---|
| 1,808,152 | A * | 6/1931 | Baily | C21D 9/46 266/259 |
| 4,299,036 | A * | 11/1981 | Schregenberger | F27B 9/28 34/216 |
| 4,582,301 | A * | 4/1986 | Wunning | F27B 9/3005 266/259 |
| 4,715,810 | A * | 12/1987 | Ramsey | C22B 1/005 432/59 |
| 4,767,320 | A * | 8/1988 | Sasaki | F27B 9/3005 432/152 |
| 4,859,251 | A * | 8/1989 | Hayami | F27B 9/028 148/286 |
| 4,884,969 | A * | 12/1989 | Kolln Bernd | F27B 9/12 432/72 |
| 6,503,365 | B1 | 1/2003 | Kim et al. | |
| 6,814,573 | B2 | 11/2004 | Hiramoto | |
| 7,029,625 | B2 | 4/2006 | Shimosato et al. | |
| 7,520,746 | B1 | 4/2009 | Johnston et al. | |

(Continued)

*Primary Examiner* — Gregory A Wilson

(74) *Attorney, Agent, or Firm* — Browdy and Neimark, PLLC

(57) ABSTRACT

A furnace working system includes a vacuumed pre-heating zone, a vacuumed gas heating zone disposed behind the pre-heating zone, a vacuumed electric heating zone, a high cooling zone disposed behind the electric heating zone, a low cooling zone disposed behind the high cooling zone, a conveyer disposed in the zones for transporting a work piece through the zones, a pipe couples the high cooling zone to the gas heating zone for supplying a heat from the high cooling zone to the gas heating zone, and a conduit couples the low cooling zone to the pre-heating zone for supplying a heat from the low cooling zone to the pre-heating zone. A transition zone is disposed between the gas heating zone and the electric heating zone.

4 Claims, 4 Drawing Sheets

(56) References Cited

U.S. PATENT DOCUMENTS

| | | | | |
|---|---|---|---|---|
| 8,298,475 | B2 * | 10/2012 | Tseng | C21D 9/46<br>266/252 |
| 9,523,136 | B2 | 12/2016 | Tseng | |
| 10,018,421 | B2 * | 7/2018 | Tseng | F27B 9/12 |
| 2010/0031776 | A1 * | 2/2010 | Englund | C21B 13/10<br>266/175 |
| 2016/0368828 | A1 * | 12/2016 | Weiand | F27D 7/06 |

* cited by examiner

CONTINUOUS WORKING SYSTEM

BACKGROUND OF THE INVENTION

1. Field of the Invention

The present invention relates to a furnace working system or facility or station or assembly, and more particularly to a high temperature and continuous furnace or working system or station or assembly including a number of units or containers that may be easily manufactured and assembled into the working system, and that include a heat recovering and economizing structure.

2. Description of the Prior Art

Typical heating furnaces or working systems or facilities or stations or assemblies comprise a number of working stations or operating zones that are separated from each other, or disposed or located close to each other for heating, carburizing, heat treating, powder metallurgy, diffusing, quenching, cooling operation, and/or the like.

U.S. Pat. No. 6,503,365 to Kim et al., U.S. Pat. No. 6,814,573 to Hiramoto, U.S. Pat. No. 7,029,625 to Shimosato et al., U.S. Pat. No. 7,520,746 to Johnston et al., U.S. Pat. No. 8,298,475 to Tseng, and U.S. Pat. No. 9,523,136 to Tseng disclose several of the typical furnace product supporting or transporting devices for supporting or transporting the typical high chromium steel materials or plates into and out of the typical steel furnaces and the like.

However, the typical furnace product supporting or transporting devices may comprise a number of working stations or operating zones that may not be easily manufactured, and should be manufactured and assembled into the working system in the factories or working plants, but the working stations or operating zones may not be easily manufactured and then assembled into the working system.

The present invention has arisen to mitigate and/or obviate the afore-described disadvantages of the conventional furnace or working systems or assemblies.

SUMMARY OF THE INVENTION

The primary objective of the present invention is to provide a furnace working system or station or assembly including a number of working sections or zones that may be easily manufactured and assembled into the working system, and that include a heat recovering and economizing structure.

In accordance with one aspect of the invention, there is provided a furnace working system comprising a pre-heating zone being vacuumed, a gas heating zone disposed behind the pre-heating zone and being vacuumed, an electric heating zone being vacuumed, a first cooling zone disposed behind the electric heating zone, a second cooling zone disposed behind the first cooling zone, a conveyer disposed in the pre-heating zone and the gas heating zone and the electric heating zone and the first and the second cooling zones for carrying and transporting a work piece through the pre-heating zone and the gas heating zone and the electric heating zone and the first and the second cooling zones, a pipe coupling the first cooling zone to the gas heating zone for supplying a heat from the first cooling zone to the gas heating zone, and a conduit coupling the second cooling zone to the pre-heating zone for supplying a heat from the second cooling zone to the pre-heating zone and for recovering the heat from the high cooling zone and/or from the low cooling zone and for heat recovering and economizing purposes.

A transition zone is disposed between the gas heating zone and the electric heating zone, and the transition zone is vacuumed. The electric heating zone includes a first heating section and at least one second heating section.

The electric heating zone includes a plurality of heating tubes disposed and engaged in the first and the at least one second heating sections. The heating tubes are disposed beside the conveyer and the work piece for suitably heating the work piece.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
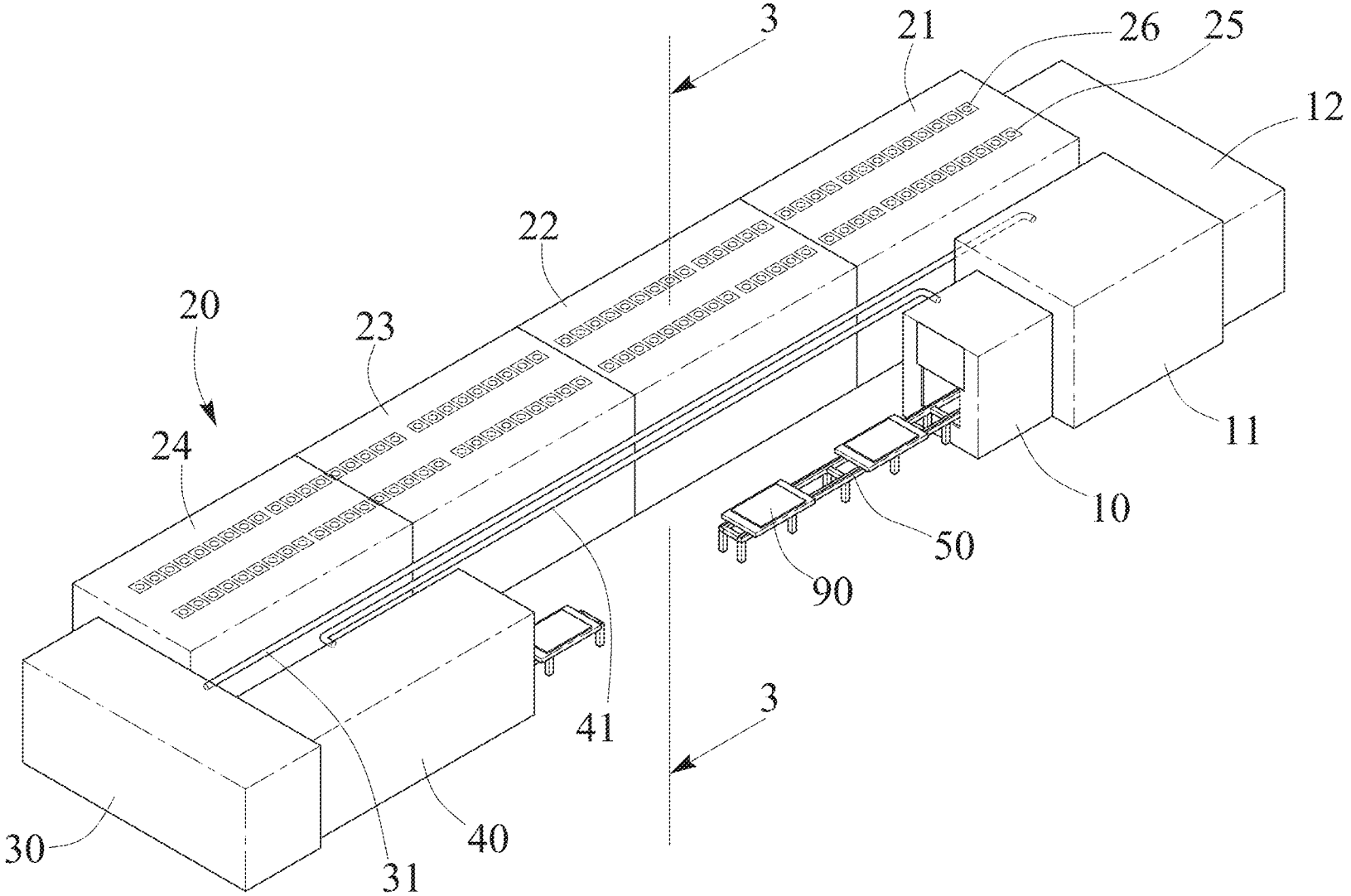
FIG. 1 is a perspective view of a working system in accordance with the present invention.
Figure 2:
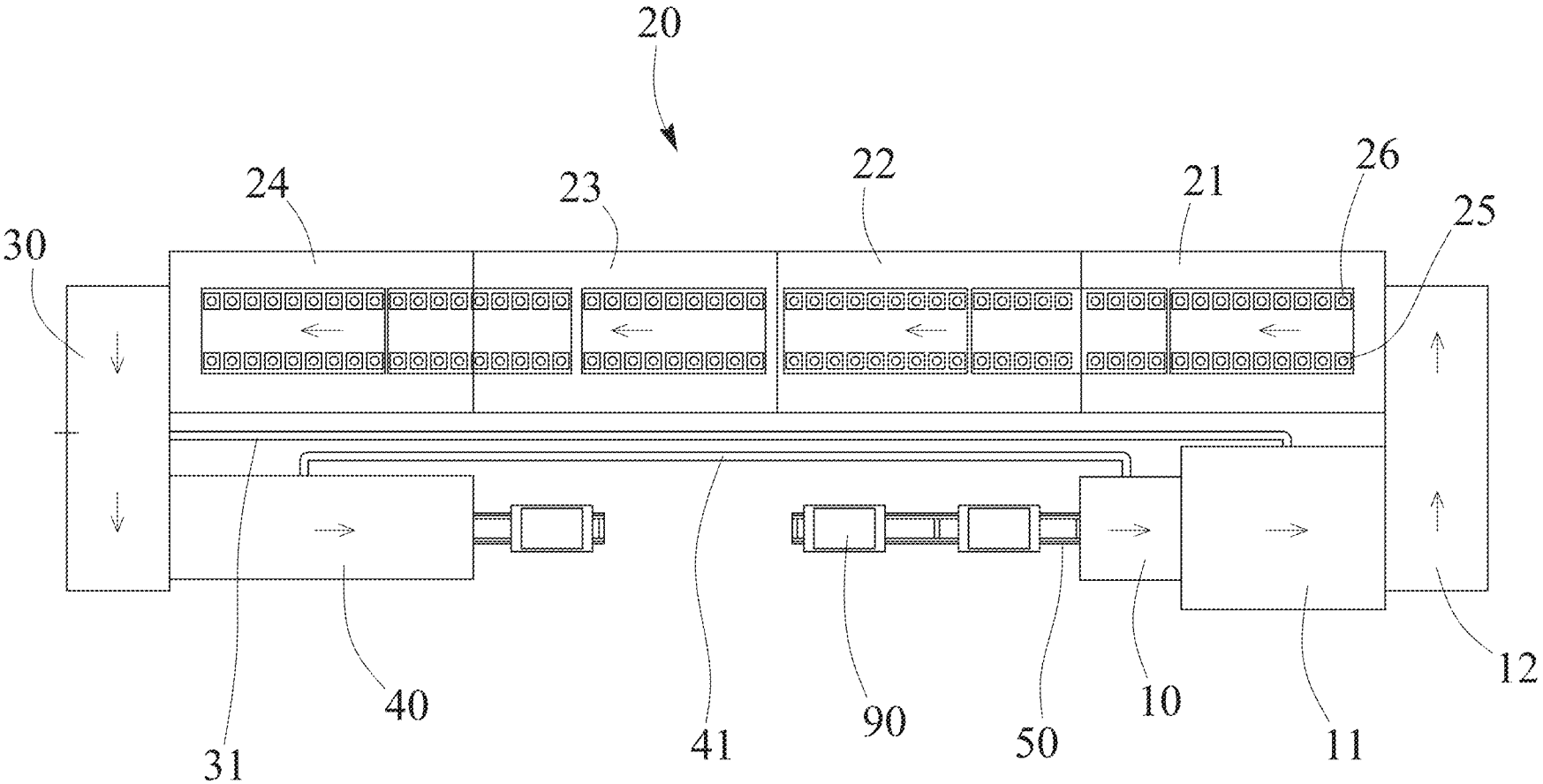
FIG. 2 is a top plan schematic view of the working system.
Figure 3:
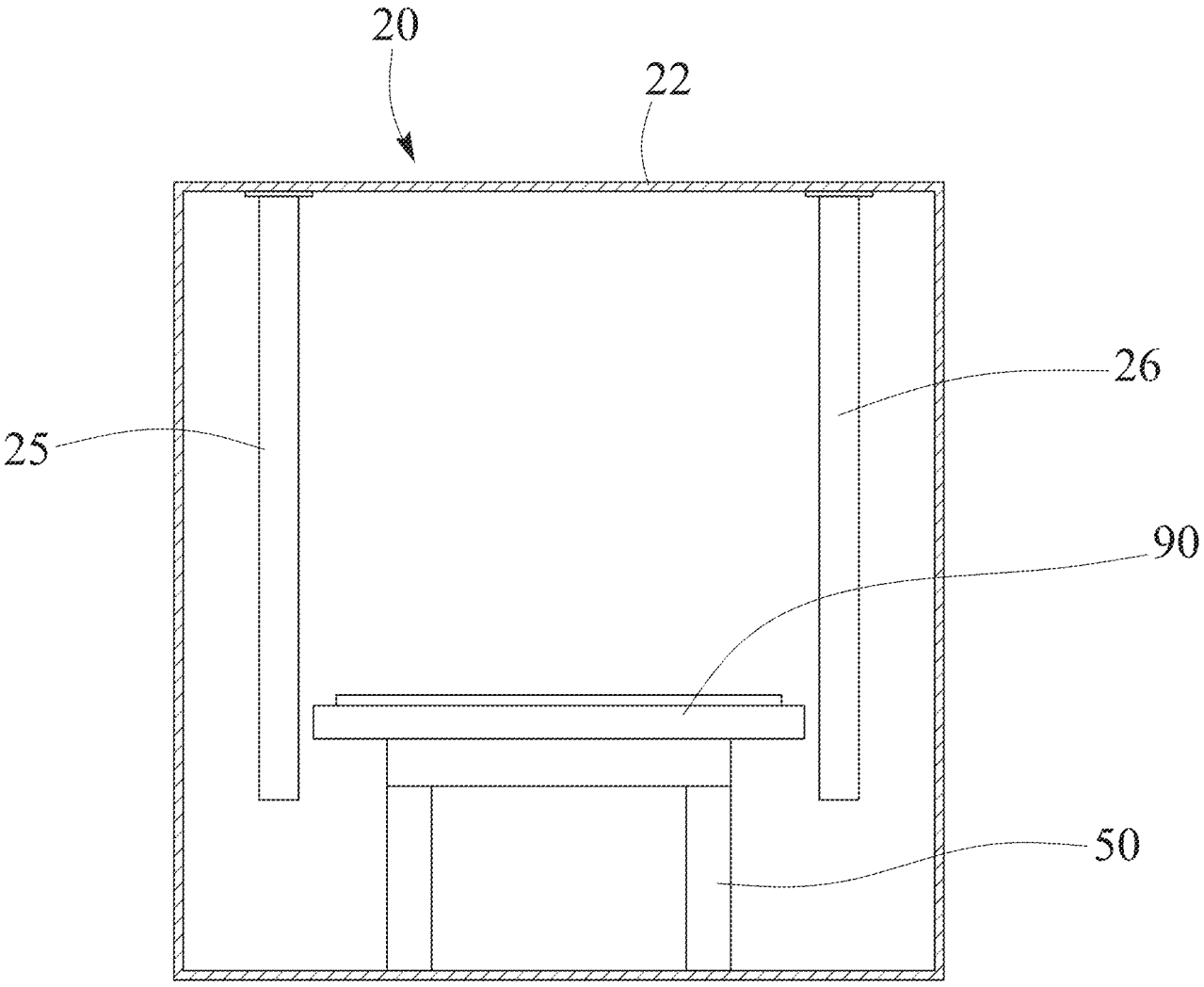
FIG. 3 is a cross sectional view of the working system, taken along lines 3-3 of FIG. 1.

Referring to the drawings, and initially to FIGS. 1-3, a furnace working system or facility or station or assembly in accordance with the present invention is provided for powder metallurgy operations or the like, for example, and the powder metallurgy operations normally comprise a number of working stations or operating zones, such as a pre-heating zone or area or section 10, a gas heating zone or area or section 11 disposed or located or arranged behind the pre-heating zone 10 for work piece heating purposes, a buffering or replacement or transition zone or area or section 12 disposed or located or arranged behind the gas heating zone 11 for work piece further heating purposes, an electric heating zone or area or section 20 disposed or located or arranged behind the transition zone 12 for work piece further heating purposes, a high or first cooling zone or area or section 30 disposed or located or arranged behind the electric heating zone 20 and a low or second cooling zone or area or section 40 disposed or located or arranged behind the high cooling zone 30 for work piece cooling purposes.

The furnace working system further comprises a belt or band or roller carrier or conveyer 50 disposed or located or arranged within and through the pre-heating zone 10, the gas heating zone 11, the transition zone 12, the electric heating zone 20 and the high and the low cooling zones 30, 40 for carrying or supporting or transporting or moving the work pieces 90 from the pre-heating zone 10 and the gas heating zone 11 and the transition zone 12 through the electric heating zone 20 and then toward and through the high and the low cooling zones 30, 40. The furnace working system comprises the pre-heating zone 10 and the gas heating zone 11 and the transition zone 12 and the electric heating zone 20 and the high and the low cooling zones 30, 40 that may be easily manufactured separately and then moved to the factories or working plants (not illustrated), and then assembled into the furnace working system. The pre-heating zone 10 and the gas heating zone 11 and the transition zone 12 and the electric heating zone 20 and the high and the low cooling zones 30, 40 may be disposed and arranged in a C or U shape or structure or configuration and the like, as shown in FIGS. 1 and 2.

It is preferable that the pre-heating zone 10 and the gas heating zone 11 and the transition zone 12 and the electric heating zone 20 and the high and the low cooling zones 30, 40 are vacuumed, or at least the pre-heating zone 10 and the gas heating zone 11 and the transition zone 12 and the electric heating zone 20 are vacuumed for maintaining the heat or the temperature of the work pieces 90 and for preventing the work pieces 90 from cooling, and/or for allowing the heat or the temperature of the work pieces 90 to be suitably maintained. The work pieces 90 in the pre-heating zone 10 and the gas heating zone 11 may be heated by gas or the like. The electric heating zone 20 includes one or more (such as four, or a first and at least one second) heating areas or sections 21, 22, 23, 24 disposed and arranged or located close to or beside or adjacent to each other and/or arranged in line with each other, and includes one or more (such as thirty six) heating devices or members or elements or tubes 25, 26 disposed or arranged or engaged in each of the heating sections 21, 22, 23, 24 for work piece heating purposes.

It is preferable that the heating tubes 25, 26 are disposed or arranged in two rows or lines in the heating sections 21, 22, 23, 24 and disposed or arranged beside the conveyer 50 and/or the work pieces 90 (FIG. 3) for suitably heating the work pieces 90 to a higher temperature. As shown in FIGS. 1 and 2, a tube or pipe 31 may be disposed or arranged or connected or coupled to the high cooling zone 30 and the gas heating zone 11 for suitably supplying the heat from the high cooling zone 30 to the gas heating zone 11 for recovering the heat from the high cooling zone 30, and/or another tube or pipe or duct or conduit 41 may be disposed or arranged or connected or coupled to the low cooling zone 40 and the pre-heating zone 10 for suitably supplying the heat from the low cooling zone 40 to the pre-heating zone 10 and for recovering the heat from the low cooling zone 40 and for heat recovering and economizing purposes. Alternatively, the heating sections 21, 22, 23, 24 of the electric heating zone 20 may be directly disposed beside or behind the gas heating zone 11 instead of beside the transition zone 12, or without the transition zone 12.

Figure 4:
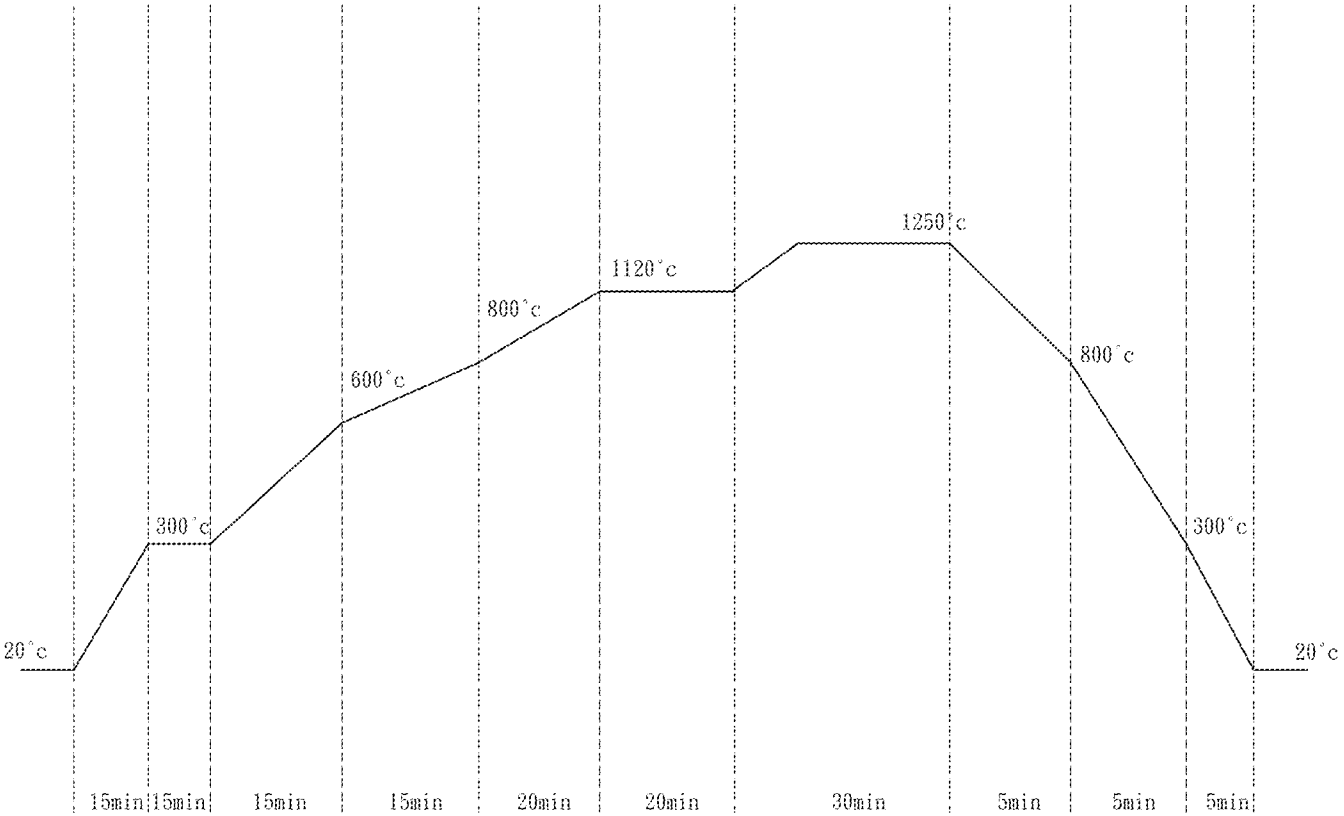
FIG. 4 is a block diagram illustrating the heating operation of the working system.

In operation, as shown in FIGS. 2 and 4, the work pieces 90 may first be transported or moved or sent into the pre-heating zone 10 for being suitably heated for about fifteen (15) minutes, by the gas and/or with the heat recovered from the low cooling zone 40, and to be heated from 20 to 300° C., or up to 450° C., in the pre-heating zone 10. The work piece 90 are then transported or moved or sent into the gas heating zone 11 for being suitably heated by the gas and/or with the heat recovered from the high cooling zone 30 for about fifteen (15) minutes, and to be heated from 300 to 600° C. in the gas heating zone 11. The work pieces 90 are then transported or moved or sent into the electric heating zone 20 and heated by the heating tubes 25, 26 and to be heated from 600 to 800° C. in the first heating section 21, and from 800 to 1120° C. in the second heating section 22, and to be suitably maintained in 1120° C. in the third heating section 23, and to be heated from 1120 to 1250° C. in the fourth heating section 24.

The work pieces 90 are then transported or moved or sent into the high cooling zone 30 and slightly or gradually lowered or decreased to the required or predetermined temperature (of about 800° C.). It is preferable that the work pieces 90 are stayed or retained in the high cooling zone 30 for about five (5) minutes, and the higher temperature of about 800 to 1250 degrees Celsius in the high or first cooling zone 30 may be selectively supplied or introduced into the gas heating zone 11 for heating the work pieces 90 and for heat preserving or economizing purposes. The work pieces 90 are then transported or moved or sent into the low or second cooling zone 40 and lowered or decreased to the required or predetermined lower temperature (of about 300° C.). It is preferable that the work pieces 90 are stayed or retained in the low or second cooling zone 40 for about five (5) minutes, and the lower temperature of about 300 to 800 degrees Celsius in the low or second cooling zone 40 may be selectively supplied or introduced into the pre-heating zone 10 for heating the work pieces 90 and for heat preserving or economizing purposes.

It is to be noted that the pre-heating zone 10 and the gas heating zone 11 and the transition zone 12 and the electric heating zone 20 and the high and the low cooling zones 30, 40 may be easily and quickly manufactured separately and then moved to the factories or working plants, and then assembled into the furnace working system. The furnace working system including at least the pre-heating zone 10 and the gas heating zone 11 and the transition zone 12 and the electric heating zone 20 are vacuumed for maintaining the heat or the temperature of the work pieces 90 and for preventing the work pieces 90 from cooling, and/or for allowing the heat or the temperature of the work pieces 90 to be suitably maintained. The heat in the high or first cooling zone 30 and in the low or second cooling zone 40 may be selectively supplied or introduced into the gas heating zone 11 and the pre-heating zone 10 for heating the work pieces 90 and for heat preserving or economizing purposes.

Accordingly, the furnace working system in accordance with the present invention includes a number of working sections or zones that may be easily manufactured and assembled into the working system, and that include a heat recovering and economizing structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A furnace working system comprising:

a pre-heating zone being vacuumed, a gas heating zone disposed behind said pre-heating zone and being vacuumed, an electric heating zone being vacuumed, a transition zone disposed between said gas heating zone and said electric heating zone, said transition zone being vacuumed, a first cooling zone disposed behind said electric heating zone, a second cooling zone disposed behind said first cooling zone, a conveyer disposed in said pre-heating zone and said gas heating zone and said electric heating zone and said first and said second cooling zones for carrying and transporting a work piece through said pre-heating zone and said gas heating zone and said electric heating zone and said first and said second cooling zones, a pipe coupling said first cooling zone to said gas heating zone for supplying a heat from said first cooling zone to said gas heating zone, and a conduit coupling said second cooling zone to said pre-heating zone for supplying a heat from said second cooling zone to said pre-heating zone.

2. The working system as claimed in claim 1, wherein said electric heating zone includes a first heating section and at least one second heating section.

3. A furnace working system comprising:

a pre-heating zone being vacuumed, a gas heating zone disposed behind said pre-heating zone and being vacuumed, an electric heating zone including a first heating section and at least one second heating section, said electric heating zone being vacuumed, a first cooling zone disposed behind said electric heating zone, a second cooling zone disposed behind said first cooling zone, a conveyer disposed in said pre-heating zone and said gas heating zone and said electric heating zone and said first and said second cooling zones for carrying and transporting a work piece through said pre-heating zone and said gas heating zone and said electric heating zone and said first and said second cooling zones, a pipe coupling said first cooling zone to said gas heating zone for supplying a heat from said first cooling zone to said gas heating zone, and a conduit coupling said second cooling zone to said pre-heating zone for supplying a heat from said second cooling zone to said pre-heating zone, wherein said electric heating zone includes a plurality of heating tubes disposed and engaged in said first and said at least one second heating sections.

4. The working system as claimed in claim 3, wherein said heating tubes are disposed beside said conveyer and the work piece.

* * * * *